United States Patent [19]

Parham

[11] Patent Number: 5,050,810

[45] Date of Patent: Sep. 24, 1991

[54] ONE-PIECE PULVERIZING ROLLER

[76] Inventor: Robert L. Parham, 1675 Larimer St., Ste. 625, Denver, Colo. 80202

[21] Appl. No.: 539,574

[22] Filed: Jun. 18, 1990

Related U.S. Application Data

[62] Division of Ser. No. 464,870, Jan. 16, 1990.

[51] Int. Cl.[5] ..... B02C 15/14

[52] U.S. Cl. ..... 241/293; 241/117

[58] Field of Search ..... 241/117, 118, 120–123, 241/126–133, 293, 300

[56] References Cited

U.S. PATENT DOCUMENTS 3,790,095 2/1974 Gillette ..... 241/117 X 4,168,807 9/1979 Dibowski et al. ..... 241/117 X

FOREIGN PATENT DOCUMENTS 1038358 9/1978 Canada ..... 241/117

*Primary Examiner*—Timothy V. Eley

*Attorney, Agent, or Firm*—Beaton & Swanson

[57] ABSTRACT

A one-piece pulverizing mill roller assembly and method of rebuilding the same. The roller assembly comprises a body, an integral hub portion and an integral circumferential outside tread portion which mates with an annular groove in a grinding table. The roller assembly is composed of a relatively lower hardness steel which will accept hard surface weld beads to rebuild the circumferential outside tread portion as it wears. The rebuilding can be performed in-place in the pulverizing mill.

4 Claims, 4 Drawing Sheets

ONE-PIECE PULVERIZING ROLLER

This is a divisional of copending application Ser. No. 07,464,870 filed on Jan. 16, 1990.

BACKGROUND OF THE INVENTION

Pulverizing mills are used to pulverize coal, limestone and other solid materials. In the case of coal, gravel sized coal enters the mill and is pulverized into a powder. The powder is carried out of the pulverizer by a high velocity air stream and into a furnace where it explosively burns to heat steam which drives a turbine to generate electricity. The pulverizers are designed to operate continuously, except during periods of repair. Examples of these kinds of coal pulverizers are in U.S. Pat. Nos. 4,705,223 by Dibowski et al; 4,694,994 by Henne et al; 4,679,739 by Hashimoto et al; 4,522,343 by Williams; 4,491,280 by Bacharach; and 4,717,082 by Guido et al.

The pulverizing is accomplished by directing the coal onto grinding tables which interface with pulverizing rollers. The rollers are each mounted on a separate roller assembly shaft, and each roller assembly shaft is mounted on a clamshell door in the pulverizer. Typically, the grinding table is a disk-shaped member with an annular groove or raised circumferential edge in the top surface. The grinding table rotates so that the annular groove mates with the rollers. The coal is introduced from the top of the assembly and feeds by gravity to the annular groove where it is pulverized as the grinding table rotates under the rollers. The rollers and grinding table are massive; each roller weighs several tons and is on the order of five feet in diameter.

The pulverizer may use a rotating grinding table with stationary roller assemblies, as described in U.S. Pat. No. 4,717,082 by Guido et al (the contents of which are hereby incorporated by reference) or, alternatively, may use a stationary grinding table and several rotating roller assemblies. The roller assemblies may also be independently biased against the grinding table so that vibration and shock on one roller will not be transferred to all the other rollers, as described in the Guido patent.

The roller assemblies typically include a rigid hard steel "tire" or "tread" portion mounted on a rigid softer hub of WCB steel. The assembled tire and hub have roughly the configuration of an automobile tire and hub but, of course, are much larger and are rigid. The roller assemblies are exposed to extreme conditions. They typically revolve at 200 to 300 revolutions per minute and operate at a temperature around 600° to 700° F. The mill occasionally catches fire. The fire is smothered with steam and is then cooled, resulting in large and fast temperature changes in the rollers.

The two-piece roller assembly comprising a tire and hub is the source of a number of costly problems in the pulverizer. A principal problem is that the tires wear out. The wear rate varies depending on the hardness of the coal and the amount of time that the pulverizer is not operating, but in general it is not unusual for the tire to wear out in less than a year. When the tire is worn out, the roller assembly must be removed from the pulverizer, the tire must be removed from the hub, the replacement tire must be mounted on the hub, and the rebuilt assembly must be replaced into the pulverizer. This requires a great deal of labor. In addition, it takes a long time, and the pulverizer can not operate during that time. The down time is typically a week or two, at a cost of many thousands of dollars per day. Electric utilities pass that cost on to rate payers.

Repairing the existing roller assemblies presents other difficulties. The existing roller assemblies require costly replacement tires. The fit between the massive tire and hub is usually quite poor and becomes worse as the assembly wears, especially since the tire is relatively hard and the hub is relatively soft. This results in vibration, abrasion and shock as the rollers crush the coal and it ultimately destroys the soft hub as well as the hard tire. As the assembly wears, the fineness of the coal deteriorates and the energy required to turn the rollers increases, resulting in a loss of mill efficiency. When a fire is smothered with steam, the differential shrinkage and expansion between the tire and hub causes extreme stress and even cracking of the tire or hub. None of the existing devices described in the patents cited above or elsewhere adequately addresses these problems.

SUMMARY OF THE INVENTION

The present invention is a one-piece roller assembly with an integral tire and hub, and a method of rebuilding the same. The one-piece roller is fabricated from a single casting of a steel that is less hard than the steel normally used for the tires in existing devices. The less hard steel allows the roller to be rebuilt when the rolling surface wears out, by applying a hard surface of steel weld beads.

The one-piece roller assembly avoids the cost of replacement tires. It also avoids the fit problems between the tire and hub and the cracking caused by differential thermal expansion and contraction, and lessens much of the shock, vibration and abrasion problems and the loss of mill efficiency and particle fineness. Moreover, the application of the hard surface weld beads can be accomplished in-place in the pulverizer without the need for time-consuming disassembly.

DETAILED DESCRIPTION OF THE PREFERRED EMBODIMENT

Figure 1:
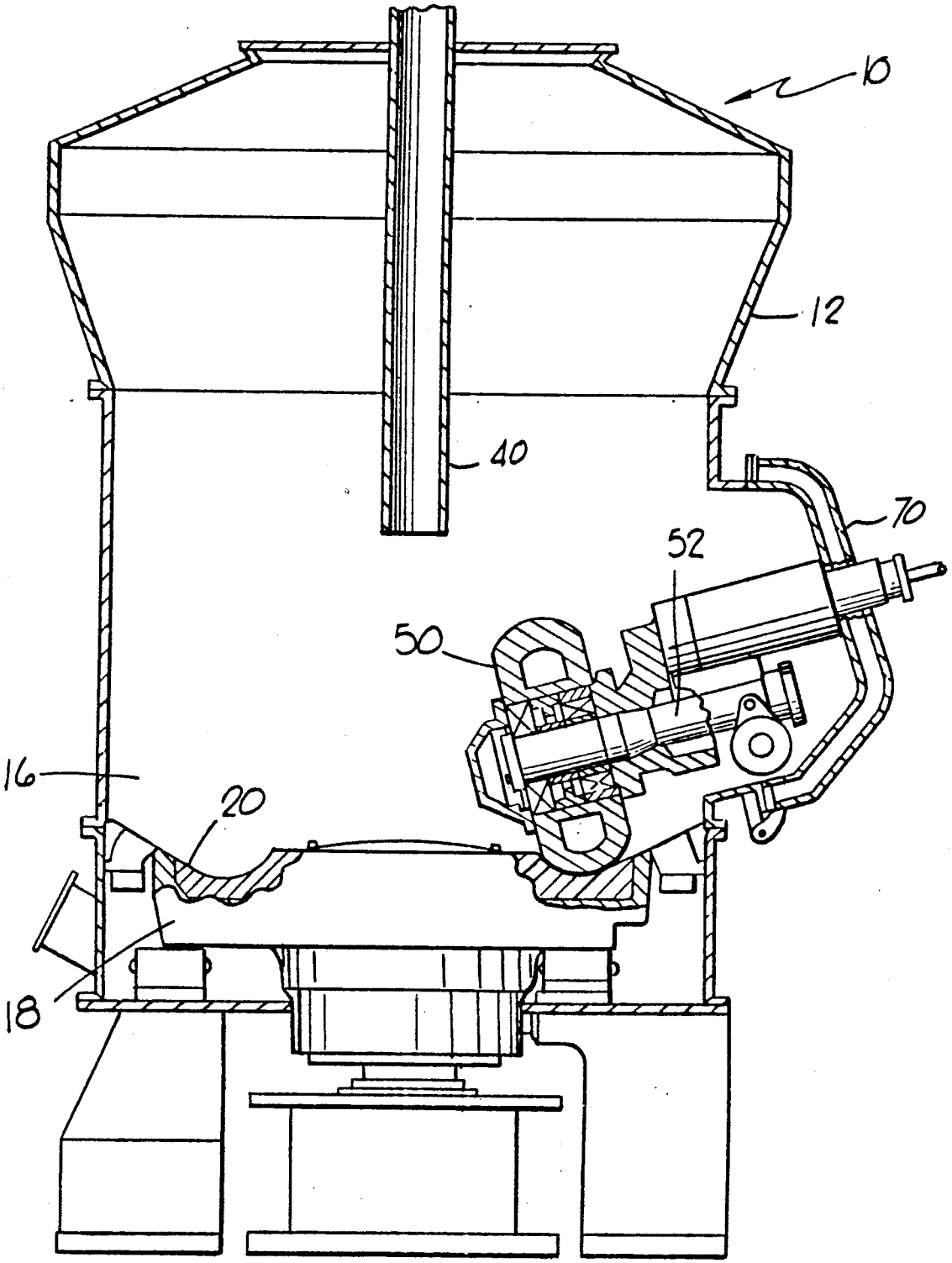
FIG. 1 shows a side view, partly in section, of a typical pulverizing mill in which the present invention may be used.

FIG. 1 shows a typical coal pulverizer mill 10 which is well known in the art. The pulverizer 10 has an outer housing 12 including an upper portion 14 and a lower pulverizing area 16. In the lower pulverizing area 16, there is a grinding table 18 with an annular groove 20 on the upper surface. A set of three roller assemblies 50 mate with an annular groove 20 in the upper surface of the grinding table 18. Each of the roller assemblies 50 rotates on the end of its own roller assembly shaft 52. Each roller assembly shaft 52 is joined at the other end to its own clamshell door 70 in the housing 12.

Unpulverized coal up to about 2 inches in diameter is introduced into the pulverizer through a coal pipe 40 in the pulverizer upper portion 14. The coal falls downward onto the grinding table 18 and into the annular groove 20. The grinding table rotates so that the annular groove 20 passes under the roller assemblies 50. The roller assemblies may be driven independently by suitable motors (not shown). The present invention would be equally applicable to a pulverizing mill in which the roller assemblies turn around a center housing and the grinding table is stationary.

Figure 2:
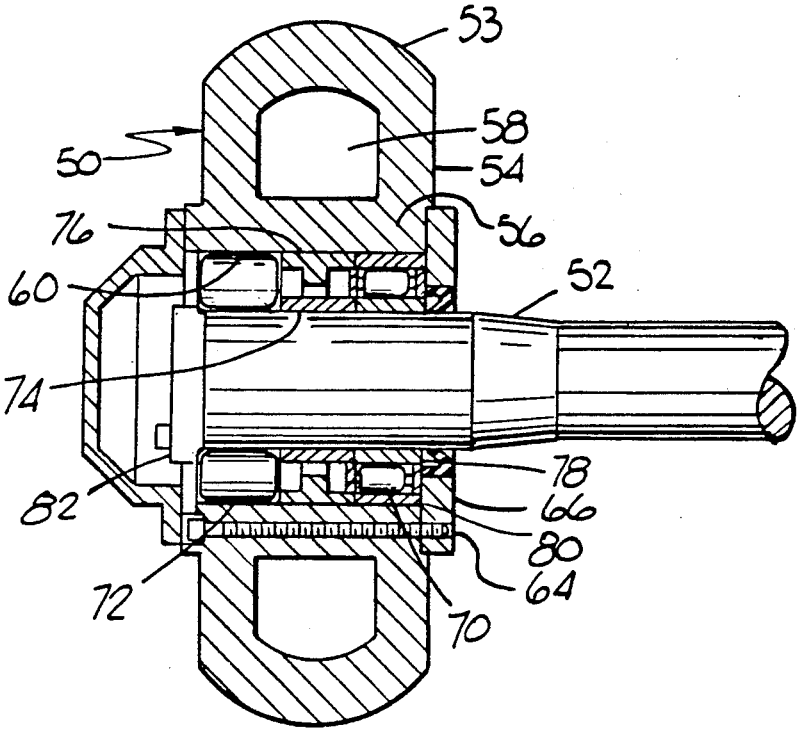
FIG. 2 shows a section view of the one-piece roller assembly of the present invention together with the roller assembly shaft.

FIG. 2 shows the one-piece roller assembly 50 of the present invention. The assembly includes a circumferential outside tread portion 53, a body portion 54, and an integral hub portion 56. The body portion 54 is hollow with an annular interior core 58. A central hole 60 in the hub portion 56 receives the roller assembly shaft 62. The roller assembly 50 is mounted on the roller assembly shaft 52 in the conventional manner. A set of attachment bolts 64 pass through the roller assembly 50 and into an roller assembly shaft flange 66 bolted or otherwise attached to the roller assembly shaft 52. A set of inner cylindrical bearings 70 and a set of outer cylindrical bearings 72 are spaced around the circumference of the roller assembly shaft 52 to receive the bearing load. The inner bearing set 70 is spaced apart from the outer bearing set 72 by a set of inner bearing spacers 74 and outer bearing spacers 76. The inner bearings 70 may ride on an annular inner race 78 and annular outer race 80. A bearing retainer 82 bolted to the roller assembly end of the roller assembly shaft 52 holds the bearing sets 70 and 72 in place. A bearing cover 84 over the bearing retainer 82 seals and protects the bearing sets 70 and 72 and covers the heads of the attachment bolts 64.

The roller assembly 50 is fabricated from a single casting of ASTM 8620 steel. They are stress relieved by controlled heating and cooling in accordance with processes known in the art to achieve a unitary casting with a hardness range of around 200 to 250 Brinnell and a tensile strength around 75,000 to 95,000 psi. The use of steel in a hardness range of 200 to 250 Brinnell is in contrast to the use of Ni-Hard steel in the hardness range of 550 Brinnell for the tires of existing two-piece roller assemblies, and allows the roller surface to be rebuilt using the welding process described herein. The hardness of 200 to 250 Brinnell is harder than the hardness of the hub and softer than the hardness of the tire of the existing two-piece assemblies. Similarly the tensile strength of 75,000 to 95,000 psi is more than the tensile strength of the hub and less than the tensile strength of the tire of the existing two-piece assemblies. This unitary construction results in a structural integrity that reduces wear, shock and vibration. The final step in fabricating the roller assemblies is to drill the appropriate bolt holes and to machine the bearing surfaces in a manner which would be apparent to one skilled in the art.

Figure 3:
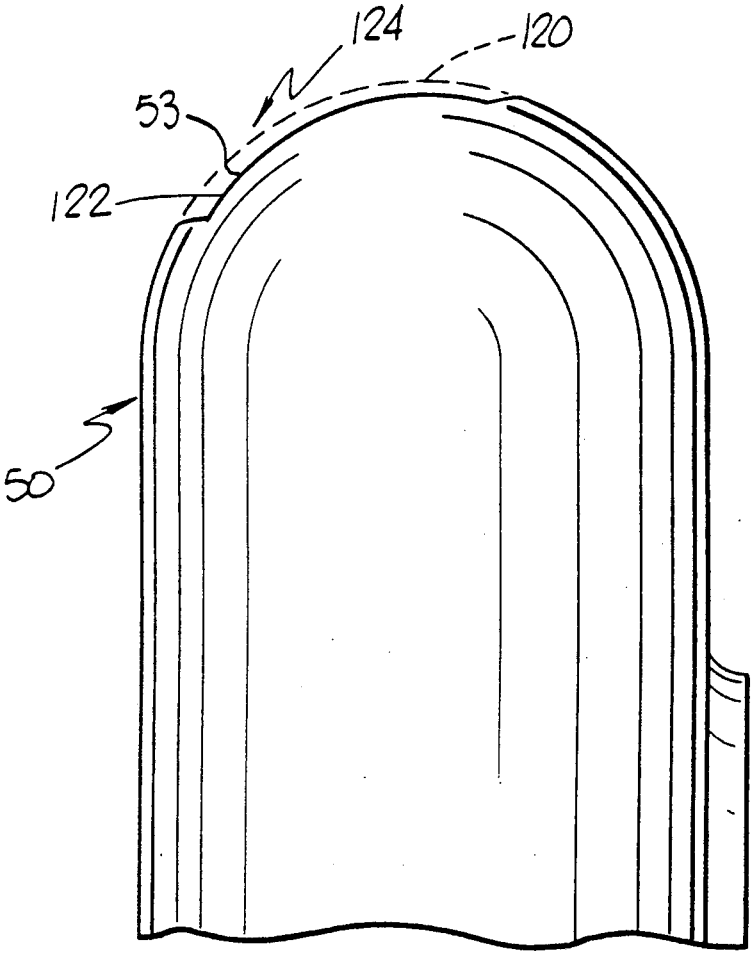
FIG. 3 shows a partial section view of the wear surface of the one-piece roller assembly of the present invention after the roller surface becomes substantially worn from operation.

FIG. 3 shows a partial section view of the one-piece roller assembly 50 after it has operated for a period of time to undergo wear on the circumferential outside tread portion 53. The dashed line 120 represents the outside tread portion 53 before the wear occurs and the solid line 122 represents the outside tread portion 53 after the wear occurs. As seen in FIG. 3, the circumferential outside tread portion 53 wears in a characteristic pattern 124 corresponding to the principal bearing surface of the roller assembly 50.

Figure 4:
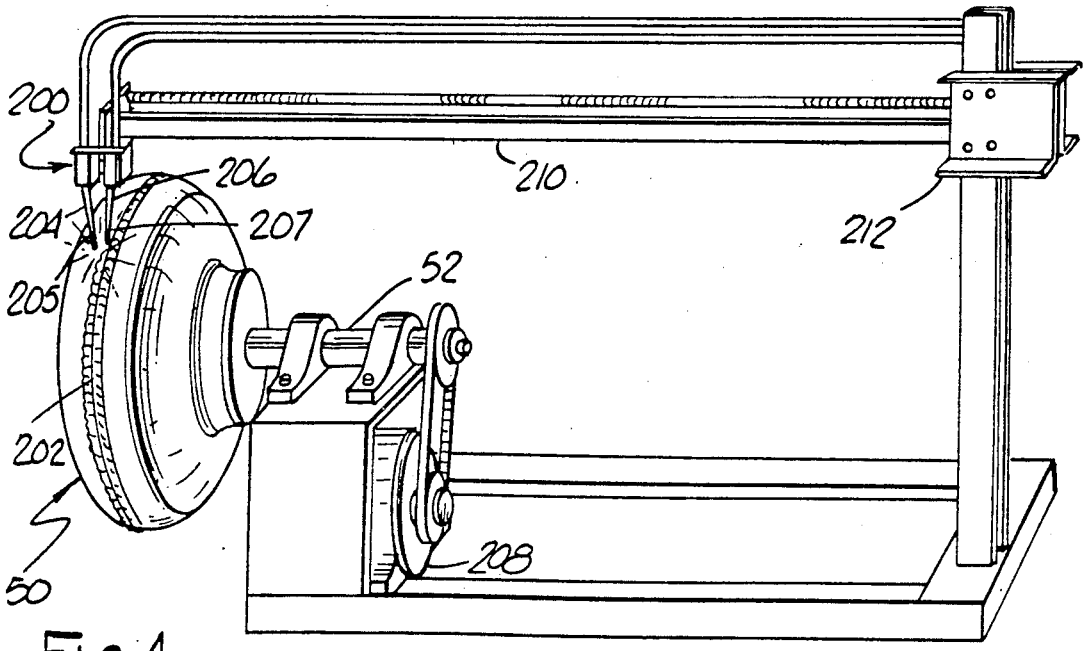
FIG. 4 shows a perspective view of a welding apparatus rebuilding the roller assembly in accordance with the process of the present invention.

Part of the present invention is a method for rebuilding the wear pattern 124 on the roller assembly 50. This is accomplished by applying a weld bead 202 to the wear pattern 124, as shown in FIG. 4. The details of the actual welding process would be apparent to one skilled in the art. Briefly, it is convenient to use a TIG or other automatic wire feed arc welder 200. The wire feed rate is about 44 inches per minute or about 50 pounds per hour using a current of 375 to 450 amps and a voltage of 28 to 34 volts. The roller assembly 50 is preheated to approximately 400° F. to improve the adhesion of the weld beads, and is allowed to cool naturally.

A weld bead 202 of high hardness steel (Brinnell Hardness of 580 to 620 in the preferred embodiment) is applied to the roller assembly wear pattern 124 shown in FIG. 3 by revolving the roller assembly 50 under a welding electrode 204 which feeds the welding wire 205 at a constant rate as shown in FIG. 4. In the preferred embodiment, a second electrode 206 is adjacent the first electrode 204 and feeds a second welding wire 207 to increase the welding rate. The revolution of the roller assembly 50 can be accomplished by an appropriate motor drive 208. The bead 202 may be adjacent circular beads applied one after another, or may be a continuous spiral bead. In the first case, the welding electrodes 204 and 206 are shifted one bead width parallel to the roller assembly shaft 52 after each complete revolution of the roller assembly 50. In the second case, the welding wire 204 and 205 is moved parallel to the roller assembly shaft 52 at a constant rate of one bead width per roller assembly revolution to result in a continuous bead covering the width of the wear pattern 124. The movement of the electrodes 204 and 206 can be done with an electrode bracket 210 that is slidable in relation to a bracket mount 212 and is in coordination with the motor drive 208 by a tooth and gear system (not shown) or other movement coordination arrangement.

The hard surface formed by the weld beads can be applied in layers until the wear pattern 124 is substantially filled. The filling of the wear pattern 124 can be checked periodically during the welding procedure using a simple jig (not shown) with a template of the desired roller assembly outside shape.

Figure 6:
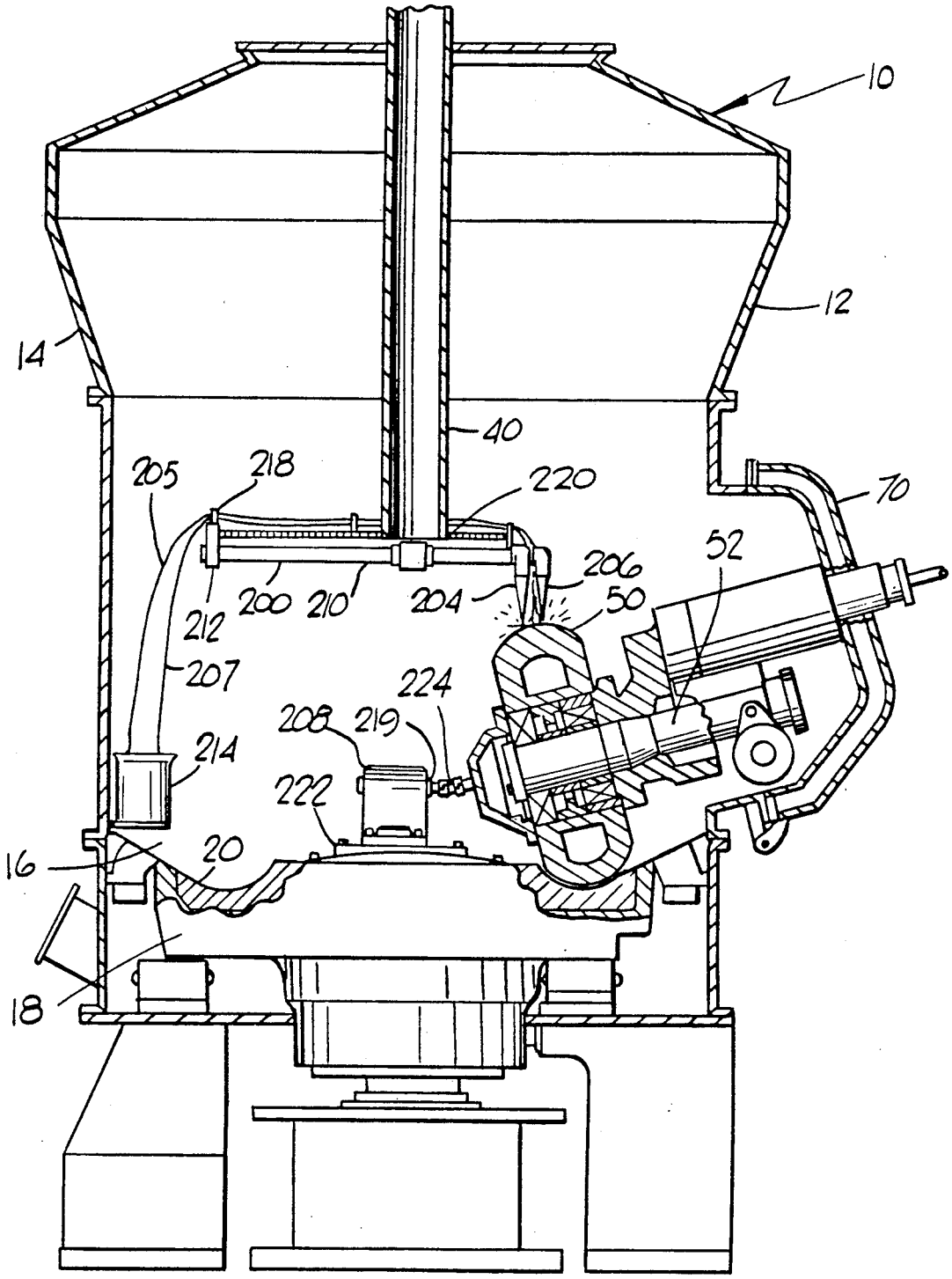
FIG. 6 shows a side view of the pulverizing mill of FIG. 1, with a welding apparatus rebuilding the roller assembly in accordance with the process of the present invention.

An important benefit of this process is that it can be performed while the roller assemblies 50 are mounted in the pulverizer 10 as shown in FIG. 6. Access to the interior of the pulverizer 10 is through the clamshell doors 70. The roller assembly 50 is jacked slightly off the qrinding table 18 to allow free revolution. The welding apparatus 200 is bolted or welded by a mount 220 to the coal pipe 40 and the electrodes 204 and 206 are positioned over the roller assembly 50 with the appropriate clearance for the welding arc. The electrode bracket 210 is slidable on the bracket mount 212 in the manner described for welding outside of the pulverizer 10. The wire bale 214 which feeds the wires 205 and 207 is positioned at a convenient location out of the way in the interior of the pulverizer 10, such as on the grinding table 18 opposite the roller assembly 50 that is being serviced, so that the 205 and 207 wire can feed through the automatic feed 218 of the bracket mount 212.

The motor drive 208 is bolted to a circular motor drive mounting plate 222 which is in turn bolted to the top center portion of the grinding table 18, with the motor shaft 209 in the general direction of the roller assembly 50 being serviced. Preferably, the motor drive mounting plate 222 is bolted to the top center portion of the grinding table 18 in such a way that the motor drive 208 and motor drive mounting plate 222 assembly can be easily rotated so that the motor shaft 219 points to each of the three roller assemblies 50, without undue effort.

The motor drive 208 is coupled to the roller assembly 50 with a universal drive apparatus 224 to avoid the need for the motor shaft 209 to be exactly in-line with the axis of the roller assembly 50. The sliding of the electrode bracket 210 on the bracket mount 212 is coordinated with the revolution of the roller assembly 50 by the motor drive 208 in the manner described for operation outside the pulverizer 10.

Figure 5:
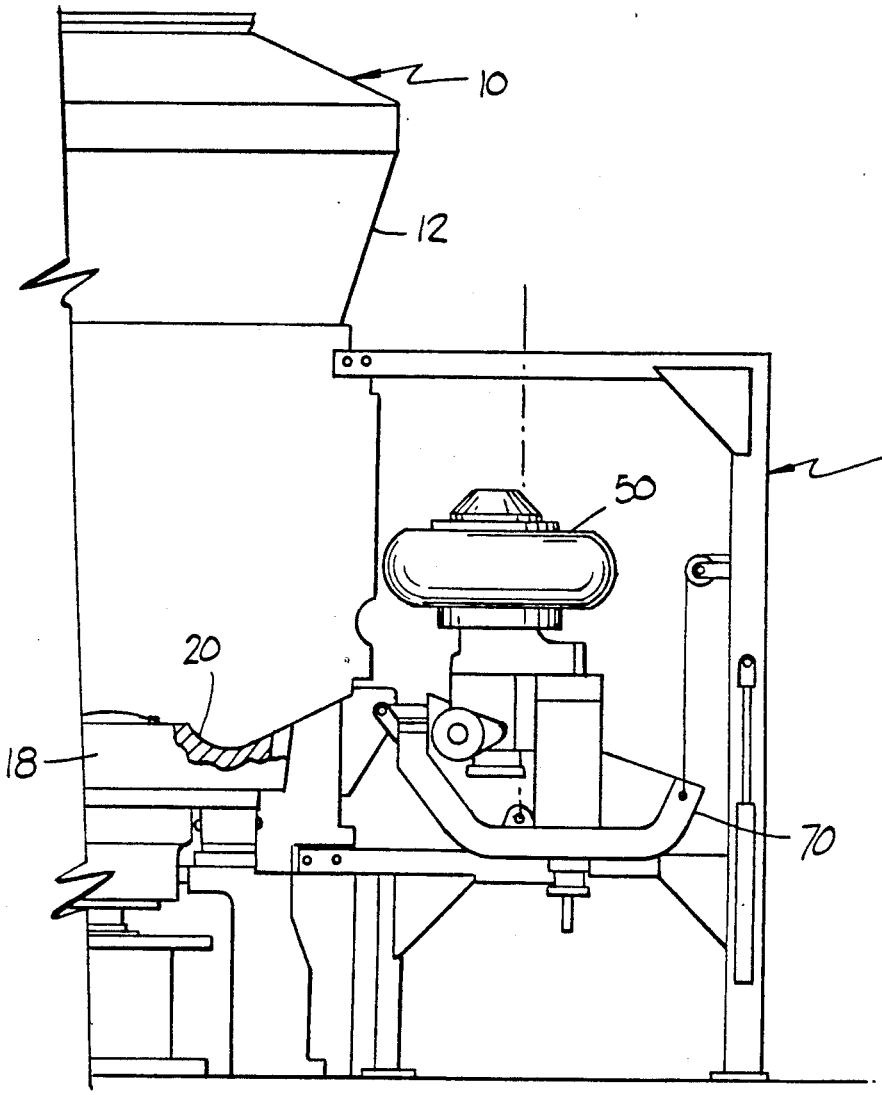
FIG. 5 shows a side view of the typical pulverizing mill of FIG. 1, with the clamshell roller assembly covers opened and a roller assembly positioned for rebuilding in accordance with the process of the present invention.

The application of the hard surface weld beads to the roller assembly can also be performed by lifting the assembly of the roller assembly, roller assembly shaft and clamshell doors outward as shown in FIG. 5. In that configuration, the removed elements are supported by a scaffold 180 and the roller assembly 50 revolves in a horizontal plane. The weld beads are applied to the roller assembly using welding apparatus (not shown) similar to that used in the in-place mode.

What is claimed is:

1. A pulverizing mill roller for mounting on a pulverizing mill shaft assembly, comprising:

(a) a roller body having a circumferential portion, said circumferential portion having a hardness of less than 300 Brinnell Hardness; and (b) an overlay of welding beads welded to said circumferential portion.

2. The roller of claim 1, wherein said roller body is fabricated from a single one-piece casting, whereby the roller has no separate hub for receiving the shaft assembly.

3. The roller of claim 2, wherein said welding beads are in the circumferential direction around said circumferential portion.

4. The roller of claim 3 wherein said overlay of welding beads has a hardness of more than 400 Brinnell Hardness.

* * * * *